US009617768B2

(12) United States Patent
Benhammou

(10) Patent No.: US 9,617,768 B2
(45) Date of Patent: Apr. 11, 2017

(54) BELT FOR ELECTROMAGNETIC SUCKER

(75) Inventor: Jacob Benhammou, La Queue-en-Brie (FR)

(73) Assignee: DIGIT, Pantin (FR)

( * ) Notice: Subject to any disclaimer, the term of this patent is extended or adjusted under 35 U.S.C. 154(b) by 220 days.

(21) Appl. No.: 12/445,917

(22) PCT Filed: Oct. 17, 2006

(86) PCT No.: PCT/FR2006/002323

§ 371 (c)(1),
(2), (4) Date: Apr. 16, 2009

(87) PCT Pub. No.: WO2008/046970

PCT Pub. Date: Apr. 24, 2008

(65) Prior Publication Data

US 2010/0194124 A1 Aug. 5, 2010

(51) Int. Cl.
*E05C 19/16* (2006.01)

(52) U.S. Cl.
CPC ..... *E05C 19/166* (2013.01)

(58) Field of Classification Search
CPC ..... E05C 19/166
USPC ..... 292/251.5; 49/208
See application file for complete search history.

(56) References Cited

U.S. PATENT DOCUMENTS 2,770,759 A * 11/1956 Ahlgren ..... 335/285
5,376,910 A * 12/1994 Geringer et al. ..... 335/278
5,516,166 A * 5/1996 Frolov et al. ..... 292/251.5
6,007,119 A 12/1999 Roth et al.
6,135,515 A 10/2000 Roth et al.
6,609,738 B1 8/2003 Roth et al.
6,758,504 B2 * 7/2004 Mandall ..... 292/251.5
6,880,868 B2 * 4/2005 Brami et al. ..... 292/251.5
6,902,214 B2 * 6/2005 Smith ..... 292/251.5
7,770,947 B2 * 8/2010 Huang ..... 292/251.5
2004/0195846 A1 * 10/2004 Chang ..... 292/340
2010/0171322 A1 * 7/2010 Chang ..... 292/251.5

FOREIGN PATENT DOCUMENTS

DE 203 06 200 7/2003
DE 20 2006 012052 10/2006
EP 2 076 645 7/2009
FR 2 889 235 2/2007

OTHER PUBLICATIONS

English Language Abstract of FR 2 865 230.

* cited by examiner

*Primary Examiner* — Kristina Fulton
*Assistant Examiner* — Christine M Mills
(74) *Attorney, Agent, or Firm* — Renner Kenner Greive Bobak Taylor & Weber; Edward G. Greive

(57) ABSTRACT

A belt for electromagnetic sucker includes a first substantially U-shaped section, a second substantially U-shaped section, an electromagnetic sucker coupled to at least one of the first and second substantially U-shaped sections, at least one of the first and second substantially U-shaped sections being structured and arranged to be secure to a support, and a connector structured and arranged to secure the first and second substantially U-shaped sections to one another.

11 Claims, 2 Drawing Sheets

BELT FOR ELECTROMAGNETIC SUCKER

The present application is a U.S. National Stage of International Patent Application No. PCT/FR2006/002323 filed Oct. 17, 2006 which published as WO 2008/046970 on Apr. 24, 2008.

BACKGROUND OF THE INVENTION

1. Field of the Invention

The present invention relates to improvements to belts for electromagnetic suckers and/or an electromagnet.

2. Discussion of Background Information

As is known, a sucker is in fact an electromagnet attached at the periphery of an opening and is capable, when excited, of retaining a reinforcing plate fixed to the door, or inversely.

In the state of the art, the sucker is fixed in a section, referred to as the belt, which is itself fixed against the support (a wall or a door).

The belt is in the form of a tubular section comprising, on one of its surfaces, an opening that is cut out to enable the sucker to be inserted and attached. This opening is advantageously used to access the other surface of the section and to enable the assembly to be fixed to the support.

Experimentation has shown that this localized fixing is insufficient on lengthy belts and, in this case, that it is necessary to use additional screws extending through the two opposite surfaces of the section, with all the risks that this involves.

The implementation of these belts is not practical because running the electric supply cables poses problems. Indeed, the cables must be connected to the sucker prior to it being fixed in the belt, which involves the following disadvantages:

- the length of the cables must be much greater than the length separating the opening for the insertion thereof and the terminals of the sucker, and this length must then be reinserted in the belt;
- the positioning of the sucker must be carried out on-site and after connection of the cables;
- a connection check-up requires disassembling the sucker.

SUMMARY OF THE INVENTION

The belt of the invention, which overcomes these disadvantages, is characterized in that it is constituted by the association of two sections each having a substantially U-shaped cross-section, one of which carries the sucker and comprises a mechanism for enabling it to be fixed to the support, whereas the other is adapted to cover the first, a mechanism is provided for affixing the two assembled sections to one another.

The invention also provides for a belt for electromagnetic sucker comprising a first substantially U-shaped section, a second substantially U-shaped section, an electromagnetic sucker coupled to one of the first and second U-shaped sections, a mechanism adapted to secure the belt to a support, and a mechanism adapted to secure the first and second U-shaped sections to one another.

The second U-shaped section may be adapted to cover the first U-shaped section. The first U-shaped section may comprise a median portion having a longitudinal groove.

The first U-shaped section may comprise a base portion that is securable to the support and two spaced apart members arranged on opposite sides of the electromagnetic sucker. The first U-shaped section may comprise a base portion that is securable to the support and to one side of the electromagnetic sucker and two spaced apart members arranged on opposite sides of the electromagnetic sucker. The first U-shaped section may comprise a base portion that is securable to the support via two connecting areas arranged on opposite sides of a middle connecting area that is securable to one side of the electromagnetic sucker and two spaced apart members securable to opposite sides of the electromagnetic sucker.

The second U-shaped section may comprise a base portion and two spaced apart members arranged on opposite sides of the electromagnetic sucker. The second U-shaped section may comprise a base portion comprising an opening which receives therein a portion of the electromagnetic sucker and two spaced apart members arranged on opposite sides of the electromagnetic sucker. The second U-shaped section may comprise a base portion comprising an opening which receives therein a portion of the electromagnetic sucker and two spaced apart members securable to two spaced apart members of the first U-shaped section.

The invention also provides for a method of assembling the belt described above to a support, wherein the method comprises securing the first U-shaped section to a support, securing the electromagnetic sucker to the first U-shaped section, and securing the second U-shaped section to the first U-shaped section.

The invention also provides for a method of assembling the belt described above to a support, wherein the method comprises securing a base portion of the first U-shaped section to a support, securing a first side of the electromagnetic sucker to a median portion of the first U-shaped section, and securing two spaced apart members of the second U-shaped section to two spaced apart members of the first U-shaped section.

The invention also provides for an electromagnet retaining assembly for a door comprising a first substantially U-shaped section, a second substantially U-shaped section, an electromagnetic coupled to one of the first and second U-shaped sections, and a mechanism adapted to secure the retaining assembly to a support. The first and second U-shaped sections may be securable to one another.

The second U-shaped section may be adapted to cover the first U-shaped section. The first U-shaped section may comprise a median portion having a longitudinal groove.

The first U-shaped section may comprise at least one of a base portion that is securable to the support and two spaced apart members arranged on opposite sides of the electromagnet, a base portion that is securable to the support and to one side of the electromagnet and two spaced apart members arranged on opposite sides of the electromagnet, and a base portion that is securable to the support via two connecting areas arranged on opposite sides of a middle connecting area that is securable to one side of the electromagnet and two spaced apart members securable to opposite sides of the electromagnet.

The second U-shaped section may comprise at least one of a base portion and two spaced apart members arranged on opposite sides of the electromagnet, a base portion comprising an opening which receives therein a portion of the electromagnet and two spaced apart members arranged on opposite sides of the electromagnet, and a base portion comprising an opening which receives therein a portion of the electromagnet and two spaced apart members securable to two spaced apart members of the first U-shaped section.

The invention also provides for a method of assembling the assembly described above to a support, wherein the method comprises securing the first U-shaped section to a support, securing the electromagnet to the first U-shaped section, and securing the second U-shaped section to the first U-shaped section.

The invention also provides for a method of assembling the assembly described above to a support, wherein the method comprises securing a base portion of the first U-shaped section to a support, securing a first side of the electromagnet to a median portion of the first U-shaped section, and securing two spaced apart members of the second U-shaped section to two spaced apart members of the first U-shaped section.

The invention also provides for an electromagnet retaining assembly for a door comprising a first substantially U-shaped section, a second substantially U-shaped section comprising an opening, an electromagnetic coupled to one of the first and second U-shaped sections and having a portion adapted to project into the opening of the second U-shaped section, and a mechanism adapted to secure the retaining assembly to a support.

The first U-shaped section may comprise at least one of a base portion that is securable to the support and two spaced apart members arranged on opposite sides of the electromagnet, a base portion that is securable to the support and to one side of the electromagnet and two spaced apart members arranged on opposite sides of the electromagnet, and a base portion that is securable to the support via two connecting areas arranged on opposite sides of a middle connecting area that is securable to one side of the electromagnet and two spaced apart members securable to opposite sides of the electromagnet. The second U-shaped section may comprise at least one of a base portion and two spaced apart members arranged on opposite sides of the electromagnet, a base portion comprising an opening which receives therein a portion of the electromagnet and two spaced apart members arranged on opposite sides of the electromagnet, and a base portion comprising an opening which receives therein a portion of the electromagnet and two spaced apart members securable to two spaced apart members of the first U-shaped section.

BRIEF DESCRIPTION OF THE DRAWINGS

The present invention will be better understood from the description that follows, with reference to the annexed drawings by way of example only, in which.

DETAILED DESCRIPTION OF THE INVENTION

Figure 1:
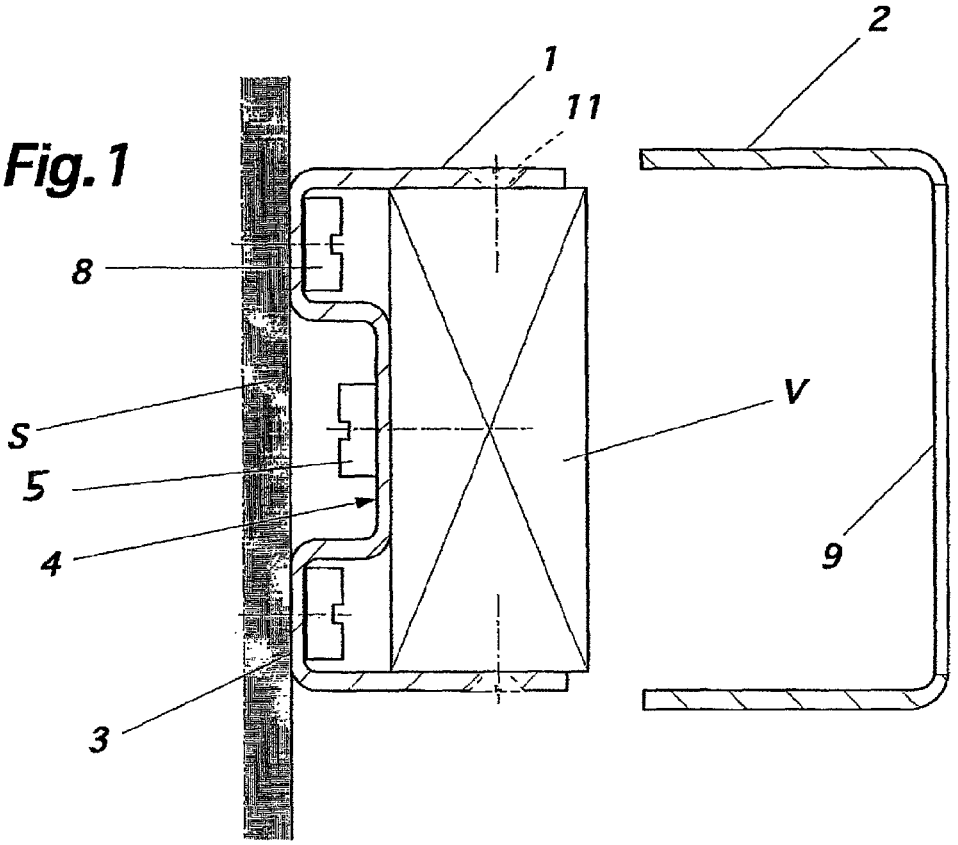
FIG. 1 shows a transverse cross-sectional view of a belt according to the invention, while being installed. The cap section is not yet assembled.

Referring to the drawings, the belt is constituted by the association or connecting together of two sections, i.e., first section 1 and second section 2 each having a substantially U-shaped cross-section. The second section 2 is capable of completely covering the first section 1.

Section 1 is provided to enable a sucker or electromagnet V to be fixed or secured in place. According to the invention, the sucker V is fixed in the section 1 prior to the section 1 being fixed to the support S. Generally, this fixing is carried out at the factory.

Figure 3:
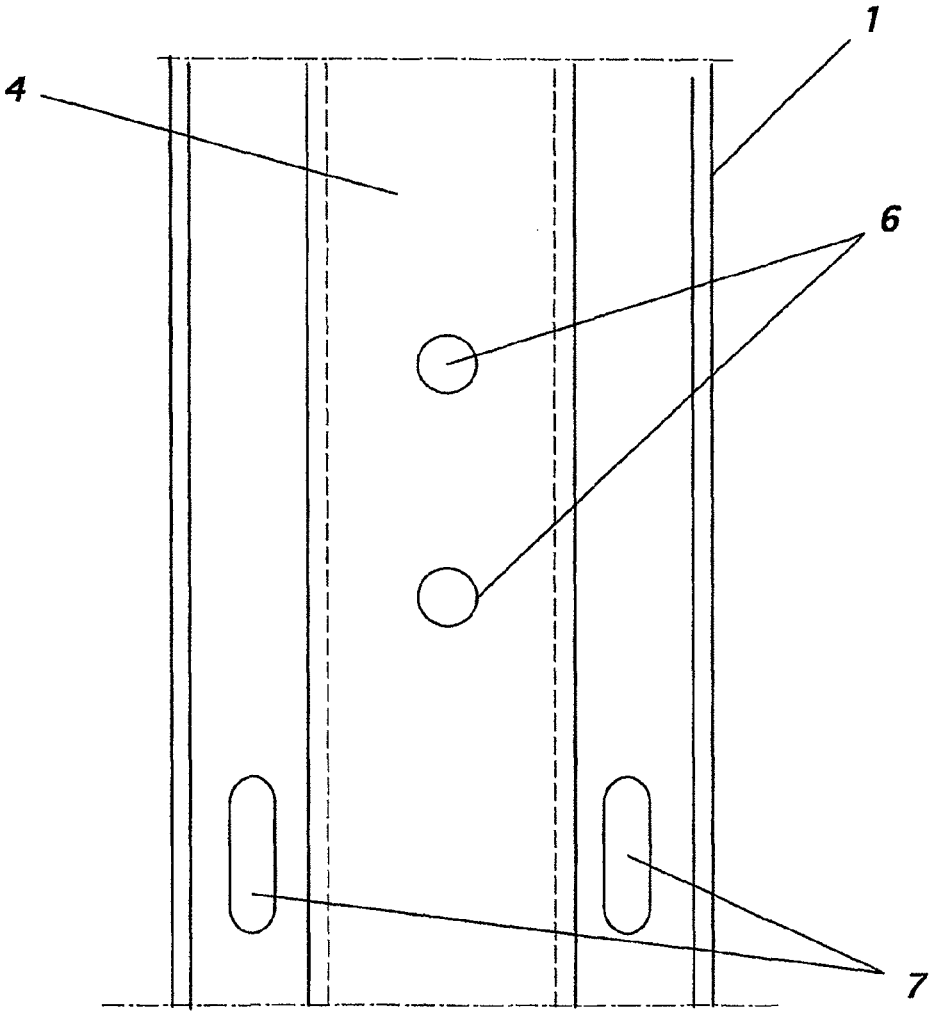
FIG. 3 is a partial end view of the section for supporting the sucker.

According to one embodiment, the median portion or base 3 of the section 1 has a longitudinal groove 4 arranged between two spaced-apart areas which are secured to the support S. The groove 4 in the base 3 defines a projecting portion, the bottom of which serves as a support for the sucker V. The sucker V is held by screws 5 extending through the bottom of the groove 4 which, as shown in FIG. 3, has holes 6 receiving the screws 5.

The spaced apart areas of the base or median portion 3 each have an opening 7, which are preferably oblong, for passage of the screws 8 for fixing the first section 1 against the support S.

The median portion of second section 2 has an opening 9 for passage of a portion of the sucker V.

After the first section 1 has been fixed, and the supply cables (not shown) connected thereafter, the assembly is covered by the second section 2, which acts in the manner of a cap. Any usual mechanisms can be used for fixing the second section 2 to the first section 1.

Figure 2:
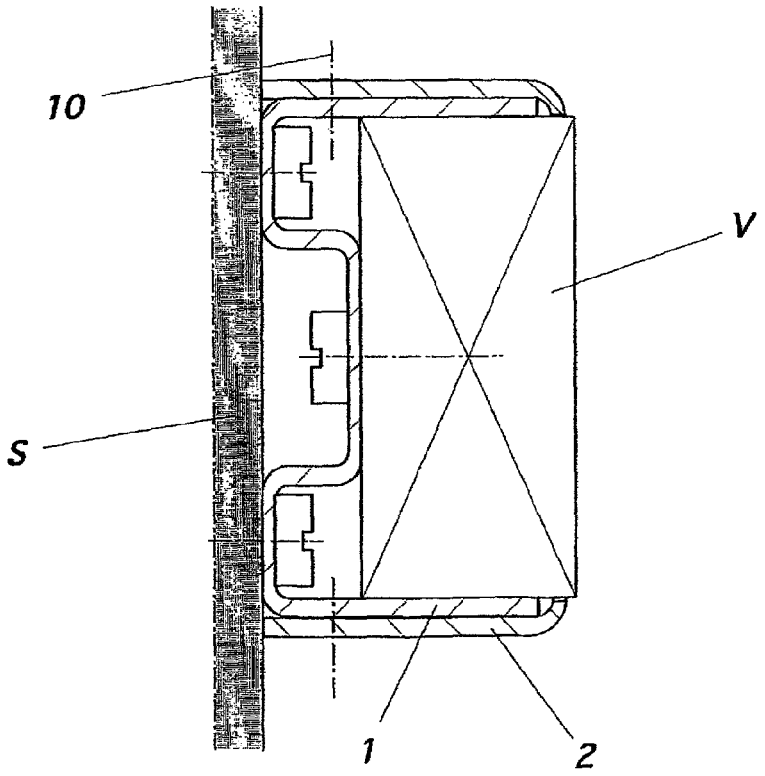
FIG. 2 shows a view similar to FIG. 1, with the belt installed. The cap section is assembled.

Thus, screws, schematically represented with axes 10 in FIG. 2, can be used for fixing together sections 1 and 2. Section 2 can also be clipped on section 1.

With respect to fixing the sucker V, this can be carried out with screws extending through the wings of section 1, such as those shown in dotted lines in FIG. 1 and schematically identified with axes 11. In this case, it is not necessary that the sucker V take support against the bottom of the groove 4.

The invention claimed is:

1. An electromagnetic sucker belt assembly comprising:

a support and a belt fixated to said support, said belt comprising:

a first substantially U-shaped section comprising a first bottom wall and two first end walls, each of said two first end walls extending substantially an entire length of said first bottom wall and having respective inner and outer faces, said first substantially U-shaped section having a first length and a first width defined by a first distance measured between said first end walls of said first substantially U-shaped section;

a second substantially U-shaped section comprising a second bottom wall and two second end walls, each of said two second end walls having respective inner and outer faces, said second substantially U-shaped section having a second length and a second width defined by a second distance between said second end walls of said second substantially U-shaped section, such that the first and second widths are respectively less than the first and second lengths and such that both the first width and the second width extend in the same direction;

an electromagnetic sucker housed into said first substantially U-shaped section; and fixing means for fixing said first substantially U-shaped section to said support through said first bottom wall of said first substantially U-shaped section;

said second substantially U-shaped section being clipped to said first substantially U-shaped section so as to cover said first substantially U-shaped section, so that said outer faces of said first end walls are in contact with said inner faces of said second end walls.

2. The belt assembly of claim 1, wherein said fixing means comprises at least one first hole made in said first bottom wall and at least one first screw passing through said at least one first hole.

3. The belt assembly of claim 2, wherein said fixing means comprises at least one second screw extending through said first bottom wall of said first substantially U-shaped section and at least one second hole formed in said first bottom wall for receiving said at least one second screw.

4. The belt assembly of claim 1, wherein one side of said first bottom wall is in contact with said support and an opposite side of said first bottom wall is in contact with said electromagnetic sucker.

5. The belt assembly of claim 1, wherein a median portion of said first bottom wall comprises a longitudinal groove, which serves as a support for said electromagnetic sucker.

6. The belt assembly of claim 1, wherein when said second substantially U-shaped section is clipped to said first substantially U-shaped section, no part of said fixing means is visible or accessible from outside the belt assembly.

7. A method for installing an assembly as defined in claim 1, the method comprising the steps of:

securing said electromagnetic sucker to said first bottom wall of said first substantially U-shaped section;

securing by said first bottom wall said first substantially U-shaped section with said electromagnetic sucker fixed thereto to said support; and clipping said second substantially U-shaped section to said first substantially U-shaped section, so as to cover said first section.

8. The method of claim 7, wherein the covering is such that no part of said fixing means are visible or accessible from outside the belt assembly.

9. A method for installing an assembly as defined in claim 1, the method comprising the steps of:

securing said first substantially U-shaped section to said support by said first bottom wall:

securing said electromagnetic sucker to said first substantially U-shaped section at said first bottom wall; and clipping said second substantially U-shaped section to said first substantially U-shaped section.

10. The method of claim 9, wherein said clipping step is performed to cover said first substantially U-shaped section.

11. The method of claim 10, wherein the covering is such that no part of said fixing means are visible or accessible from outside the belt assembly.

* * * * *